United States Patent [19]

Tung et al.

[11] 4,052,114

[45] Oct. 4, 1977

[54] JALOPY SHELF FOR BOTTLES

[75] Inventors: Hsu Yun Tung; Tzong Ren Wu, both of Taipei, China /Taiwan

[73] Assignee: Hsu Yun-Tung, Teipe, China /Taiwan

[21] Appl. No.: 650,773

[22] Filed: Jan. 20, 1976

[51] Int. Cl.[2] ..... A47B 95/02; A47F 5/08; A47B 17/04; A47B 97/00

[52] U.S. Cl. ..... 312/245; 312/204; D6/144; D12/71

[58] Field of Search ..... 312/245, 204, 209; D6/144, 153, 154; D12/91; 24/248 L, 248 B, 248.2; 211/89; 248/203

[56] References Cited

U.S. PATENT DOCUMENTS

| | | | |
|---|---|---|---|
| 356,225 | 1/1887 | Dufeu | 24/248.2 |
| 512,101 | 1/1894 | Eastes | 312/209 |
| 679,267 | 7/1901 | Stockett, Jr. | 24/248 B |
| 754,483 | 3/1904 | Mustgrove | 248/203 |
| 1,120,542 | 12/1914 | Rogers | 248/203 |
| 1,141,333 | 6/1915 | Hardisty | 24/241 PP |
| 2,470,993 | 5/1949 | Kramer | 312/204 |
| 2,575,441 | 11/1951 | Burnett | 312/246 |
| 2,621,098 | 12/1952 | Ford et al. | 312/204 |
| 2,783,771 | 3/1957 | Thomas | 24/279 |
| 3,082,050 | 3/1963 | Baxter et al. | 312/209 |
| 3,101,185 | 8/1963 | Gustafson | 211/89 |
| D. 36,936 | 5/1904 | Wilkinson | D12/91 |
| D. 38,058 | 6/1906 | Robin | D6/153 |

*Primary Examiner*—Paul R. Gilliam
*Assistant Examiner*—V. N. Sakran
*Attorney, Agent, or Firm*—Cushman, Darby & Cushman

[57] ABSTRACT

A jalopy shelf for bottles having characteristics of conveneint use and beautiful decoration can be installed in the restaurant, living room or other recreation places.

This jalopy shelf is characterized in that two hangers are provided on the car side so as to hang the jalopy onto the wall and an openable hood is fitted on the bonnet of such a jalopy. The upper portion of the bonnet may be placed with bottles, cups, forks and knives; the lower portion thereof may be designed as drawer type which can be open at the front end of said jalopy. Several holders are provided on the driver's cushion and tread so as to support the wine bottles thereon. A pushable plate is further engaged beneath the tread so that it may give the space to store more bottles when the plate is pulled out.

1 Claim, 5 Drawing Figures

JALOPY SHELF FOR BOTTLES

BACKGROUND OF THE INVENTION

The conventional shelf for bottles is generally formed as a big sideboard or cabinet and having such defects as unstable handling of wine bottle. The present inventor has improved this defect and discloses a beautifully decorative jalopy shelf which can be stored with wine bottles, utensils and the like for convenient handling.

SUMMARY OF THE INVENTION

The present invention relates to a decorative shelf formed as a jalopy characterized in that the fixation plates are provided in the bonnet so as to store the bottles for utensils and the upper hood is openable. At the front end of said jalopy, a vertical door plate serves as a cover and a handle fixed on said plate serves to open this door plate. A pushable drawer is engaged in said door plate. Several holders for supporting bottles are fixed on the tread and driver's cushion. A pushable plate is engaged into the groove beneath the tread so as to push or pull said pushable plate.

A hanger device is provided for said jalopy shelf so that the jalopy may be hung onto the wall by such a device in which one end is fixed on the wall by a steel nail and another end is connected to the jalopy body.

DESCRIPTION OF THE PREFERRED EMBODIMENT

Figure 1:
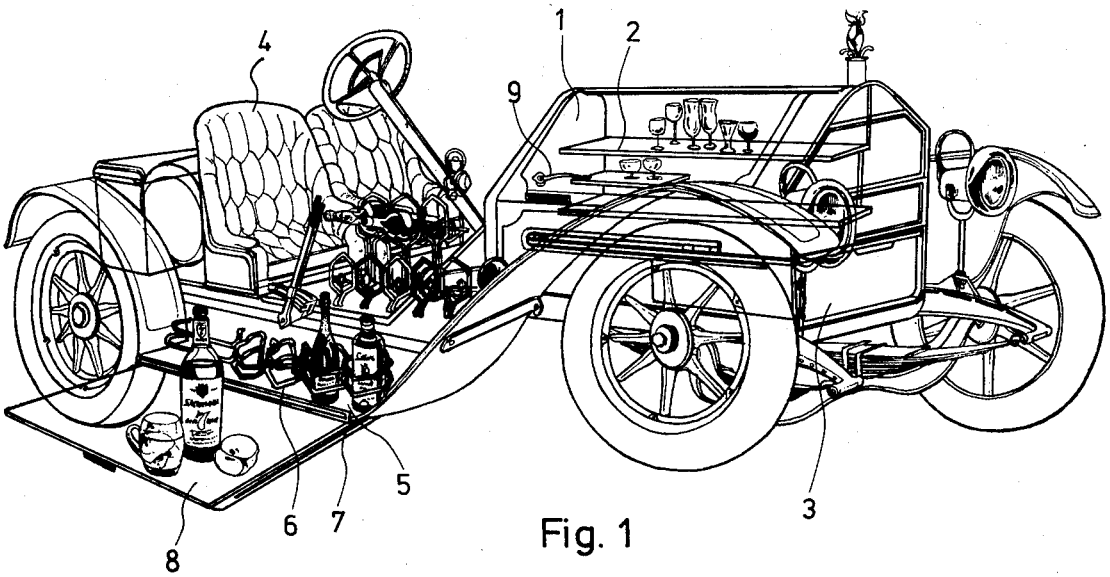
FIG. 1 is the perspective drawing of the present invention.

The present invention is formed by a jalopy body which is essentially improved and designed to become a new and special shelf of bottles. An openable hood plate 1 is mounted on the bonnet. Within said bonnet, a fixed plate 2 is installed in the upper portion of said bonnet so as to store the wine bottles and other utensils and in the lower portion of said bonnet which also belongs to the front end portion of said jalopy is provided with a door plate 3 wherein a shelf type drawer is engaged.

Several holders 6 for supporting bottles are mounted on the driver's cushion 4 and tread 5 so as to store the opened or unopened bottles. Groove 7 is formed beneath the tread or runningboard 5 so as to engage a movable plate 8 which, also as a drawer, may be stored something.

Figure 2:
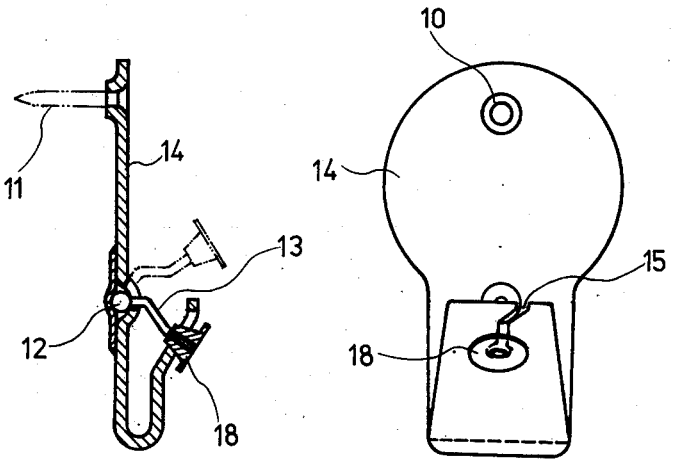
FIG. 2 is the drawing of a hanger device for fixing the jalopy on the wall.
Figure 3:
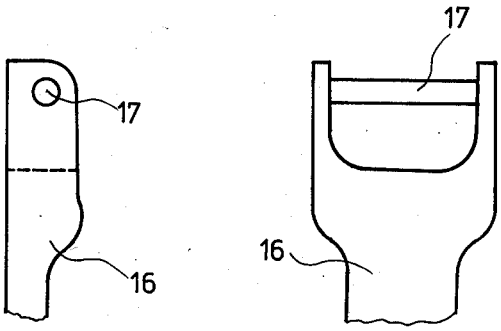
FIG. 3 is the drawing of the hanging device of the jalopy body.
Figure 4:
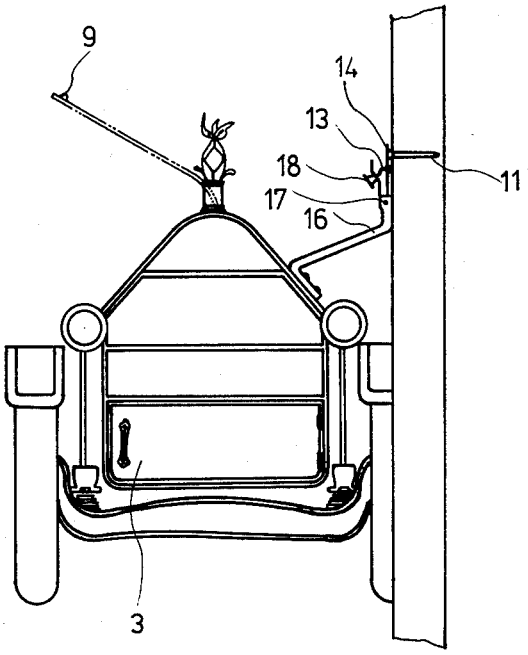
FIG. 4 is the drawing of the present embodiment hung onto the wall.
Figure 5:
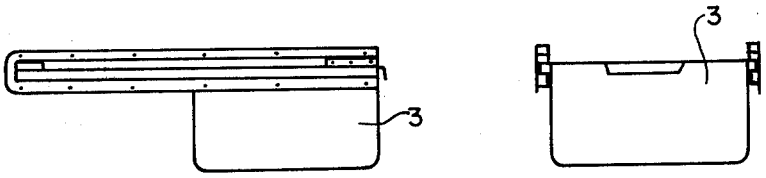
FIG. 5 is the drawing of the bottom drawer of the present invention.

The present jalopy shelf is hung onto the wall by means of a special hanger device according to the present invention. As shown in FIG. 2, hanger 14 is mounted onto the wall by fixing a steel nail through a hole 10 thereon. In the middle portion of said hanger, it has been formed as an extended arc shape wherein a small movable steel ball 12 is engaged. A bending link 13 is connected outward from said steel ball 12 and is ended by a pre-set screw 18. Said hanger 14 is formed as a hook shape on its lower portion. A recessed groove 15 is formed in the central position of the hook end so as to coincide with the hanger 16 on the jalopy body of which a horizontal bar 17 can be engaged into the bending hook of hanger 14, then by pushing the bending link 13 into recessed groove 15 and fixing the screw 18, the jalopy can be hung onto the wall.

We claim:

1. A decorative shelf for storing wine bottles and the like which resembles an automobile and comprises:

a frame formed to resemble a vehicle body with seats, runningboard, and engine compartment;

a hood pivotably connected to said frame for closing said compartment;

a plurality of shelves mounted within said compartment;

a track connected to said frame;

a drawer engaging said tracks for sliding movement below said compartment between a closed and open position;

a plurality of racks mounted on said frame between said seats and compartment and on said runningboard for supporting a plurality of bottles;

a second shelf movably mounted beneath said running board; and at least one shelf hanging means including a first hanger plate fixed to said frame and including a bar, a second hanger plate adapted to be fastened to a wall at one end, formed as a hook at the other end with a recessed groove formed in the hook end and having an aperture in the middle thereof, a bending link having a ball at one end extending through said aperture for permitting pivoting movement of said link, and means for engaging the other end of said link for holding said bar in said hook.

* * * * *